US005247717A

United States Patent [19]

Smith

[11] Patent Number: 5,247,717

[45] Date of Patent: Sep. 28, 1993

[54] DEBRIS/LITTER COLLECTING APPARATUS

[76] Inventor: Owen Smith, 8330 N. 19th Ave., #3126, Phoenix, Ariz. 85021

[21] Appl. No.: 778,743

[22] Filed: Oct. 18, 1991

Related U.S. Application Data

[63] Continuation of Ser. No. 425,334, Oct. 23, 1989, abandoned.

[51] Int. Cl.[5] ..... E01H 1/00

[52] U.S. Cl. ..... 15/80; 15/82; 15/84; 15/194; 56/328.1; 56/364; 171/63; 414/488

[58] Field of Search ..... 414/437–441, 414/488; 15/82–87, 78, 54, 55, 182, 340.3, 340.4, 179, 194; 56/327.1, 328.1, 344, 364, DIG. 12; 198/698, 399.1; 171/63

[56] References Cited

U.S. PATENT DOCUMENTS

| | | | |
|---|---|---|---|
| 2,679,133 | 5/1954 | Soderholm | 56/328.1 |
| 2,916,753 | 12/1959 | Redpath et al. | 15/84 |
| 3,126,693 | 3/1964 | Renn | 56/364 |
| 3,228,053 | 1/1966 | Horton et al. | 15/82 X |
| 3,261,152 | 7/1966 | Johnson et al. | 56/328.1 |
| 3,649,984 | 3/1972 | Kershaw et al. | 15/55 X |
| 3,872,657 | 3/1975 | Ramacher et al. | 56/328.1 |
| 3,993,141 | 11/1976 | Donohue | 15/83 X |
| 4,144,610 | 3/1979 | Moore et al. | 15/55 X |
| 4,434,011 | 2/1984 | Moore | 15/78 X |
| 4,550,465 | 11/1985 | Chrisley | 15/84 |
| 4,593,426 | 6/1986 | Chrisley | 15/84 |
| 4,603,544 | 8/1986 | Hayhurst | 56/328.1 |
| 4,608,725 | 9/1986 | Jackson | 56/328.1 X |
| 4,722,175 | 2/1988 | Hobhouse | 56/327.1 X |
| 4,727,714 | 3/1988 | Karakolev et al. | 56/327.1 |
| 4,888,845 | 12/1989 | Ramm et al. | 15/55 X |
| 4,914,774 | 4/1990 | Sheehan et al. | 15/83 X |

FOREIGN PATENT DOCUMENTS

| | | | |
|---|---|---|---|
| 105040 | 4/1984 | European Pat. Off. | 15/78 |
| 121118 | 10/1984 | European Pat. Off. | 15/78 |
| 1409 | 3/1899 | Fed. Rep. of Germany | 15/182 |
| 2327103 | 12/1974 | Fed. Rep. of Germany | 56/364 |
| 148359 | 5/1981 | Fed. Rep. of Germany | 15/179 |
| 590104 | 3/1959 | Italy | 56/328.1 |
| 24383 | of 1901 | Switzerland | 15/78 |
| 192093 | 10/1937 | Switzerland | 15/84 |
| 216195 | 4/1968 | U.S.S.R. | 15/88.3 |
| 1230525 | 5/1986 | U.S.S.R. | 56/328.1 |
| 1331936 | 8/1987 | U.S.S.R. | 15/78 |
| 2156667 | 10/1985 | United Kingdom | 15/78 |

*Primary Examiner*—Harvey C. Hornsby
*Assistant Examiner*—C. Cooley
*Attorney, Agent, or Firm*—Burns, Doane, Swecker & Mathis

[57] ABSTRACT

An apparatus for collecting litter from the ground includes a frame adapted for movement along the ground, a hopper mounted at one end of the frame; and a collector assembly supported on the frame. The collector assembly includes a pair of rollers having a plurality of flexible fingers disposed radially on the periphery thereof, the rollers being substantially parallel to each other and disposed in a plane that is substantially parallel to the ground. The rollers are arranged so that the fingers on one of the pair of rollers intermesh with the fingers of the other of the pair of rollers so as to be able to lift litter between them. The apparatus further includes a device for conveying litter lifted by the pair of rollers to the hopper. The conveying device includes a plurality of fingers that intermesh with the fingers of one of the pair of rollers so as to remove the litter from the one roller, and a system for rotating the pair of rollers and the conveyor about axes that are substantially transverse to the direction of movement of the frame.

10 Claims, 8 Drawing Sheets

DEBRIS/LITTER COLLECTING APPARATUS

This application is a continuation of application Ser. No. 425,334, filed Oct. 23, 1989, now abandoned.

BACKGROUND OF THE INVENTION

1. Field of the Invention

The present invention is directed to debris and litter collecting machines of the type that are generally intended to cover relatively large areas over which debris may be scattered, such as parks, beaches, highways, etc., and to retrieve the debris or litter that is commonly encountered in these areas.

2. Description of Related Art

Various litter collecting machines of this general type are disclosed, for example, in U.S. Pat. Nos. 2,916,753; 3,993,141; 4,550,465 and 4,593,426. Litter retrieval machines of this type basically comprise a device for picking litter up from the ground, a storage bin or hopper for receiving the litter that has been picked up, and some form of means for transferring the litter from the collecting device to the storage bin.

A device substantially similar to that disclosed in abandoned U.S. patent application, Ser. No. 06/606,583 has been sold in the United States more than one year prior to the filing of this application.

In some of these machines, the transfer of the collected litter from the collector to the storage bin involves a number of discrete handling steps in which the litter goes from one location to another between the ground and the storage bin. However, each time that a piece of litter must be handled by a separate piece of structure in the machine provides an instance in which the overall collecting efficiency of the machine can be reduced. For example, when a transfer of litter between two relatively moving machine elements is required, it is always possible that flexible types of litter such as cardboard cartons or paper wrappers can become jammed between the two elements and, rather than being transferred from one to the other, be returned to the ground or require stoppage of the machine to clear the obstruction. In another type of action, collected litter may be allowed to freely drop from one type of handling apparatus into another. For example, it may fall from a collecting roller into a trap area where it is picked up by a subsequent handling device. In such situations, it is entirely possible that litter such as glass bottles or the like may break as it falls into the trap area, allowing the smaller pieces to drop through spaces in the machine and return to the ground.

Some litter collecting machines, such as those disclosed in the previously noted '141 patent, employ a relatively simple collecting concept that does not involve numerous handling steps in transferring the litter from the collecting device to the storage bin. However, the basic collecting device itself is also simple in concept, comprising a series of relatively rigid rods mounted on a shaft and adapted to picking up certain types of litter or litter of certain sizes that is capable of being wedged between the rods.

A further disadvantage of litter collecting machines that utilize a plurality of flexible fingers to collect litter, such as those disclosed in U.S. Pat. Nos. 4,550,465 and 4,593,426, is that the fingers are subject to wear, thus reducing their effectiveness. The fingers in the prior art machines are difficult to replace.

SUMMARY OF THE INVENTION

The present invention includes an apparatus for collecting litter from the ground that comprises a frame adapted for movement along the ground; a hopper mounted at one end of the frame; and a collector assembly supported on the frame. The collector assembly includes a pair of rollers having a plurality of flexible fingers disposed radially on the periphery thereof, the rollers being substantially parallel to each other and disposed in a plane that is substantially parallel to the ground. The rollers are arranged so that the fingers on one of the pair of rollers intermesh with the fingers on the other of the pair of rollers so as to be able to lift litter between them. The apparatus further includes means for conveying litter lifted by the pair of rollers to the hopper, the conveying means including a plurality of fingers that intermesh with the fingers of one of the pair of rollers so as to remove the litter from the one roller, and means for rotating the pair of rollers and the conveyor about axes that are substantially transverse to the direction of movement of said frame.

DETAILED DESCRIPTION OF THE PREFERRED EMBODIMENTS

Figure 1:
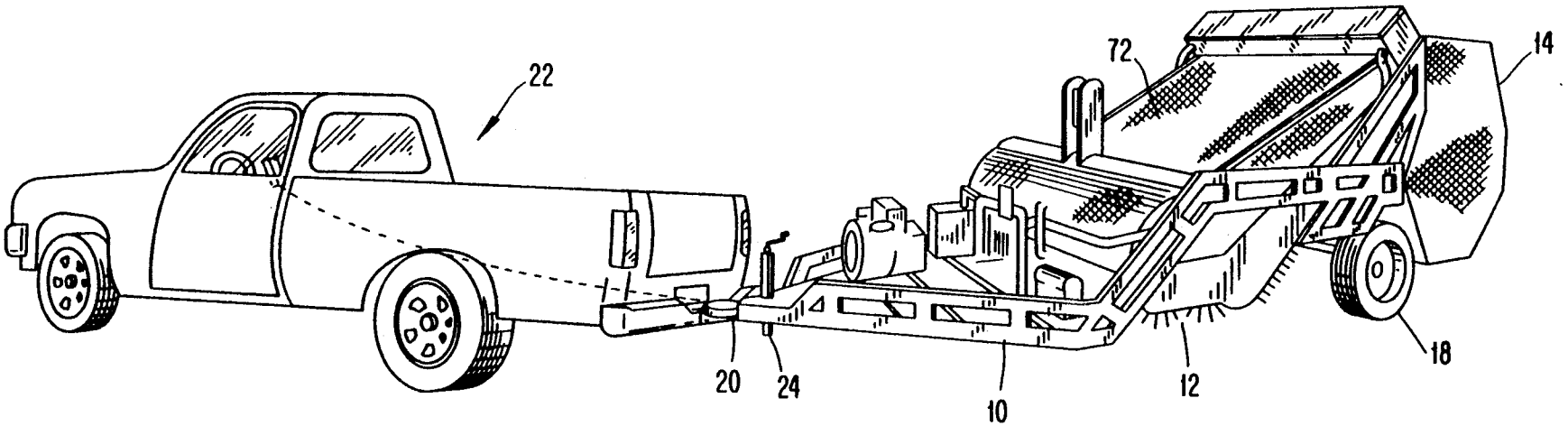
FIG. 1 is a perspective view of a litter collecting machine implementing the principles of the present invention, the machine being shown in operation wherein it is towed behind a pickup truck.
Figure 2:
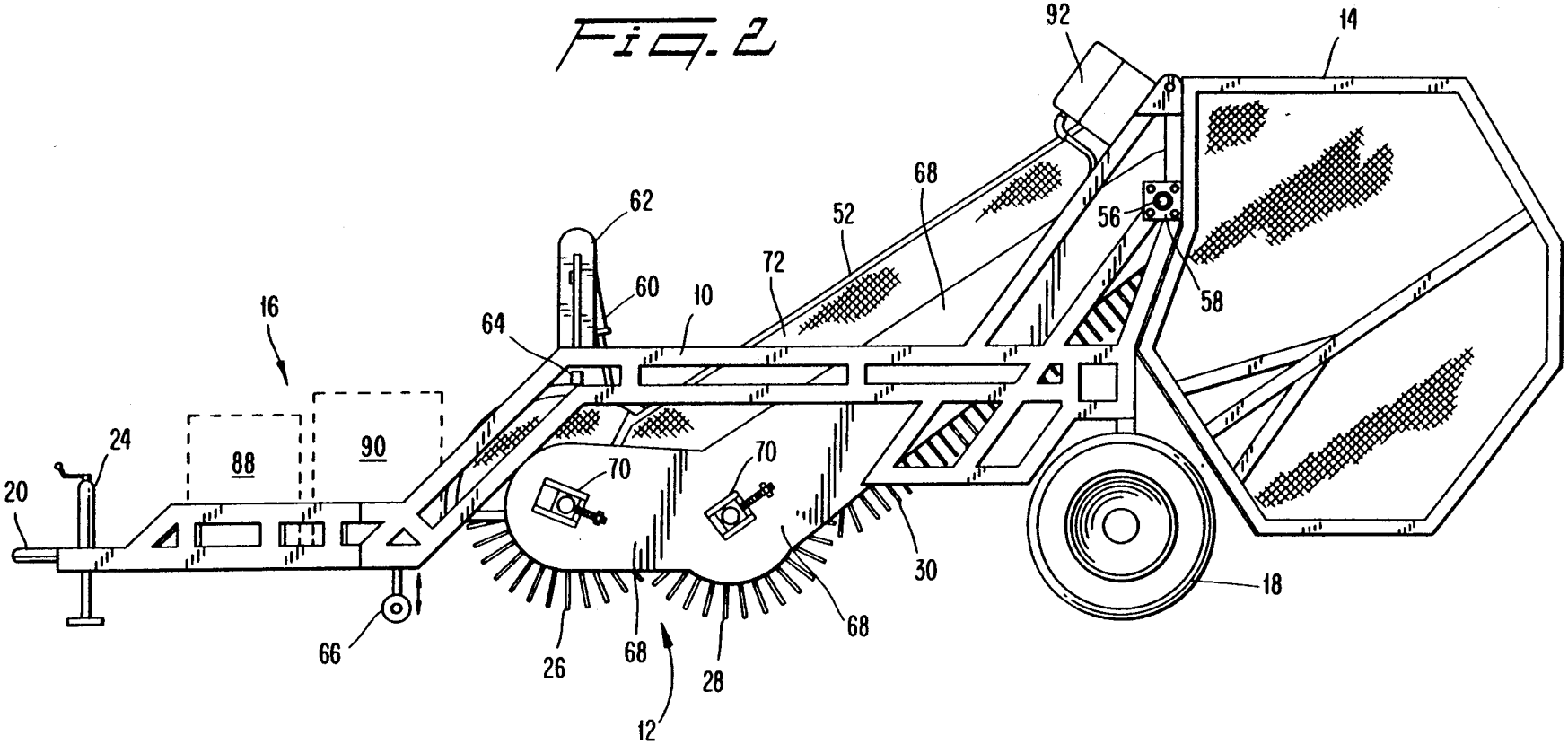
FIG. 2 is left side view of the machine in elevation.

Referring to FIGS. 1 and 2, a litter collecting machine constructed in accordance with the principles of the present invention basically comprises four subassemblies. These subassemblies are a frame 10, a collector assembly 12, a storage bin or hopper 14, and an hydraulic control and power network 16. The frame 10 supports the other three assemblies, and is adapted for movement along the ground by means of a pair of wheels 18 provided at one end thereof. The other end of the frame includes a suitable hitch 20 for attachment of the machine to an appropriate towing vehicle, such as a pickup truck 22 as shown in FIG. 1, for moving the machine over the area to be cleaned. The towable version illustrated in the drawings can be provided with a suitable jack 24 to support the machine when it is not in use.

Figure 3:
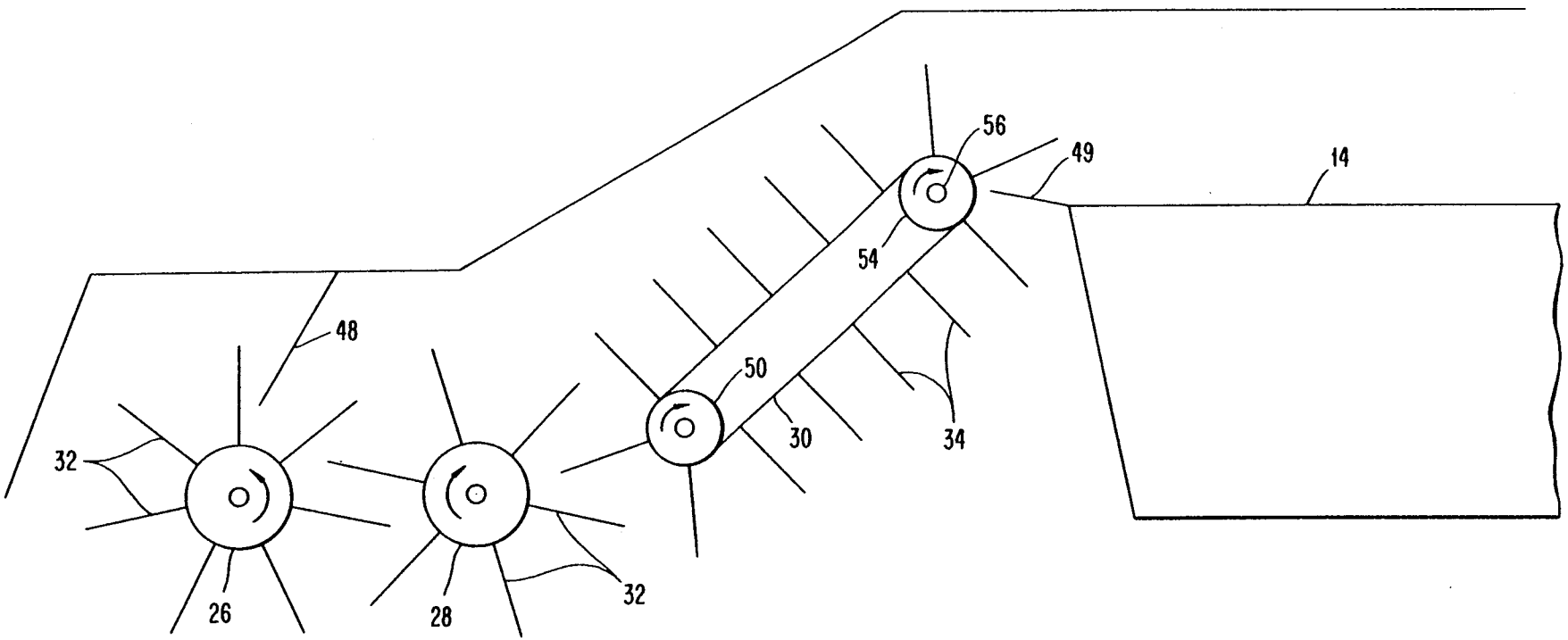
FIG. 3 is a schematic view illustrating the operation of the first preferred embodiment of the machine.

With reference to FIG. 3, the collector assembly 12 comprises two pickup rollers 26, 28 and an inclined conveyor 30. Each of the pickup rollers 26, 28 and the conveyor 30 extends substantially over the width of the collecting machine. The pickup rollers 26, 28 are parallel to each other, and are contained in a horizontal plane, raised above and parallel to the surface that is to be cleaned.

As shown schematically in FIG. 3, each of the rollers 26, 28 is provided with a plurality of flexible, radially extending fingers 32 over the peripheral surface thereof. The fingers 32 are preferably of a solid cylindrical configuration, and extend about 10 to 11 inches from the peripheral surface of the rollers 26, 28. The fingers 32 are preferably made from a thermal urethane having a durometer reading of about 95.

The rollers 26, 28 may comprise a metal tube that is concentrically supported on a shaft. The fingers 32 are mounted on the tube in spaced rows extending into both the axial and circumferential directions.

The inclined conveyor 30 has a lower forward end adjacent the pickup roller 28, and an upper rearward end in an operative relationship with the hopper 14. The conveyor belt 30 can be constructed of rubber, flexible metal, such as steel mesh, or any other suitable material. The belt is supported by a lower guide roller 50 and an upper guide roller 54.

The fingers 34 on the conveyor 30 are made from a material that enables the fingers to be heavier and stiffer than the fingers 32 used on the pickup rollers 26, 28.

Figure 4A:
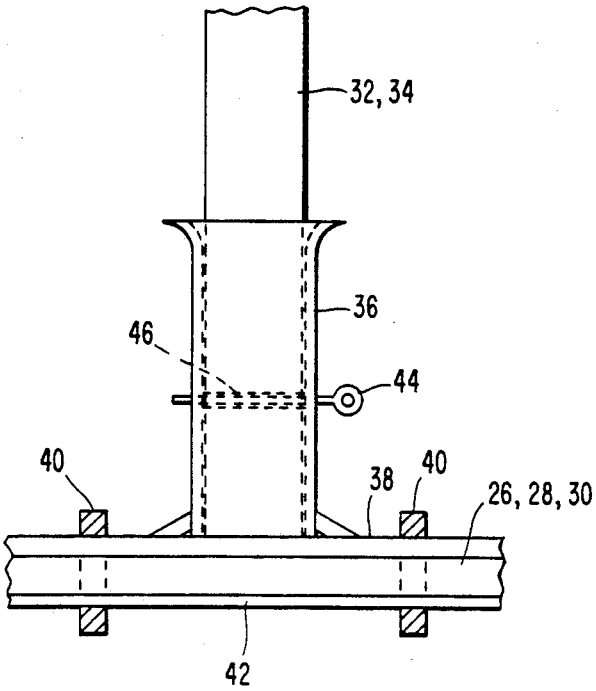
FIG. 4A is a view of a assembly for connecting fingers to the rollers and the conveyor belt of the machine.

With reference to FIG. 4A, an assembly for mounting the fingers to either the conveyor belt 30 or the rollers 26, 28 includes a tubular element 36 having a flared top that is welded or otherwise fastened to a strap 38 that is bolted or otherwise secured to the conveyor belt 30 or roller 26, 28 by means of bolts 40 and a supporting strap 42. The fingers 32, 34 are simply inserted into the tube 36 and a shear pin 44 is inserted through an opening 46 in the tube 36 and a corresponding opening in the finger. By using the tube 36 to support the fingers, the fingers are stiffer at the base than at the end, thus resulting in an advantageous flicking action.

If desired, an opening made be made in the belt 30 (or roller 26, 28) in alignment with the tubular element 36 so that a finger of a length longer than necessary may be used. The extra length of the finger may be recessed through the opening in the belt (or roller). As the tip of the finger wears, the finger may be pulled out of the tube 36 until it is the desired length and then resecured with the shear pin 44. In this way a finger about twenty inches long may be used, even though only eight to ten inches protrude from the belt or roller.

Figure 4B:
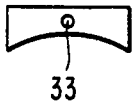
FIG. 4B is a cross section of an alternative design for a finger used in the present invention.

In FIG. 4B, a design for a finger is illustrated, wherein the finger is substantially rectangular in cross section, although the front surface is somewhat concave. The preferred size for such a finger is approximately ¼"×1", although other sizes may be used. The fingers may be designed such that they are wider at the end extending away from the conveyor belt or roller. Such a design minimizes the spacing between the fingers. However, fingers that are circular in cross section may also be used. For increased stiffness, a cable 33 may be provided in the center of the finger.

The direction of rotation of the pickup rollers 26, 28 is indicated by arrows marked on the respective rollers in FIG. 3. As can be best seen in FIG. 3, the pickup rollers 26, 28 are driven in opposite directions such that the fingers 32 of pickup roller 26 overlap and intermesh with the fingers 32 of pickup roller 28. For example, if the fingers each have a length in the range of 10 to 11 inches, the overlap might be about 8 inches along a line intersecting the axes of rotation of the pickup rollers 26, 28.

A clean out rake 48 may also be provided on the frame in a manner so that it is suspended above the pickup roller 26 such that the teeth of the rake 48 interengage with the fingers 32 of the pickup roller 26. A purpose of the clean out rake 48 is to dislodge any litter that may have been stuck between adjacent fingers 32 of the pickup roller 26.

The conveyor assembly 30 is mounted adjacent the pickup roller 28 such that the fingers 34 of the conveyor 30 interengage with the fingers 32 of the pickup roller 28. The direction of rotation of the conveyor 30 is also indicted by arrows in FIG. 3. With respect to the perspective shown in FIG. 3, the conveyor assembly moves in a clockwise direction such that the fingers 34 of the conveyor move upwardly between the fingers 32 of the pickup roller 28 as the fingers 32 of the pickup roller 28 are moving in a downward direction. The interaction of the fingers 34 of the conveyor 30 and the fingers 32 of the pickup roller 28 serve to dislodge any litter being carried by the fingers 32 of the pickup roller 28 and to convey the dislodged litter along the upper surface of conveyor 30. As the litter passes over the top of the conveyor 30, it is deposited into the hopper 14 for subsequent disposal. An additional rake 49 may be provided on the hopper 14 for dislodging litter from the fingers 34 of the conveyor 30 as the fingers 34 pass over the top of the conveyor.

The overlap between the fingers 34 of the conveyor 30 and the fingers 32 of pickup roller 28 is similar to the overlap between the fingers 32 of the pickup rollers 26, 28. For example, if the fingers each have a length in the range of 10 to 11 inches, the overlap might be about 8 inches.

The conveyor 30 is supported by a lower guide roller 50 and an upper guide roller 54.

Each of the pickup rollers 26, 28 and the lower guide roller 50 for the conveyor 30 are mounted for rotation on a subframe, or casing, 52. The subframe 52 is in turn mounted on the frame 10 by means of a pivotal connection. The pivot axis for the subframe 52 is concentric with the axis of rotation of the upper guide roller 54 for the conveyor 30. In other words, a common shaft 56 supports both the upper guide roller 54 and the subframe 52 on the frame 10. With respect to FIG. 2, the shaft 56 can be mounted on the frame 10 by means of a pair of pillow blocks 58 having bearings that suitably support the shaft for rotation.

The pivoting motion of the subframe 52 about the shaft 56 is controlled by means of an hydraulic cylinder 60. One end of the cylinder 60 is mounted between a pair of support posts 62 that project upwardly from the frame 10. The other end of the cylinder is attached to the forward end of the subframe 52. When the cylinder 60 is retracted, the subframe 52 and hence the pickup rollers 26, 28 and the lower end of the conveyor 30 are raised to permit suitable clearance for transporting the machine when it is not in use.

To safely lock the collecting subassembly in this raised position during transport, one or more upstanding flanges 64 can be provided on the subframe 52 and secured to the frame 10 by means of pins, bolts, or the like. During use, the cylinder 60 can be extended and retracted as appropriate to maintain the pickup rollers 26, 28 and the lower end of the conveyor 30 at an appropriate height relative to the frame to keep the fingers 32 of the rollers in engagement with the ground.

The machine can also be provided with means for automatically controlling the cylinder 60 in order to maintain the rollers 26, 28 and the conveyor 30 at the proper position relative to the ground. Such means might include, for example, a vertically reciprocable feeler wheel 66 that rides on the ground and moves relative to the frame 10 or to the collector subassembly. A pressure or position responsive sensor coupled to the feeler wheel support provides a signal that is indicative of the position of the collector subassembly 52 relative to the ground. This signal can be used to control the cylinder 60 to regulate the position of the subassembly 52.

The subframe 52 includes a pair of metal plates 68 that are disposed on each side of the machine and encase the ends of the pickup rollers 26, 28 and the conveyor support rollers 50, 54. The shafts for the pickup rollers 26, 28 and the guide rollers 50, 54 of the conveyor 30 are supported on these plates 68. The positions of the shafts for the pickup rollers 26, 28 and the shaft for the lower conveyor guide roller 50 can be adjusted relative to each other by means of suitable positioning devices 70 mounted on the plates 68, as shown in FIG. 2. The positioning devices 70 can be movable relative to the plates 68 by means of a threaded rod and fixed nut assembly, as illustrated, or can be any other suitable conventional mechanism for adjusting the radial position of the shafts.

The plates 68 on either side of the machine are connected to one another by means of an expanded metal cover 72. The cover 72 encloses the fingers 34 on the upper half of the conveyor 30 and functions to maintain litter on the conveyor as it is being transported from the location of the pickup rollers 26, 28 to the hopper 14. The cover 72 also extends to enclose the top half of the pickup rollers 26, 28.

The pickup rollers 26, 28 and the conveyor 30 are each independently driven in rotation by means of variable speed hydraulic motors (not shown). These hydraulic motors are mounted on the pair of plates 68 on one side of the machine and are respectively connected to the shafts of the pickup rollers 26, 28 and the lower guide roller 50 for the conveyor 30.

The positive drive of the pickup rollers 26, 28 and the conveyor 30 that is provided by the hydraulic motors is preferable to the friction drive that was typically employed in prior types of litter collectors. Generally, these friction drive types of collectors utilized a wheel that was in engagement with the ground and that drove a gear box mechanism which in turn rotated the various pickup elements, e.g., brushes or rollers, of the collector. When the collector is employed on uneven terrain as might be typically encountered in parks or the like, the friction drive wheel would often come out of engagement with the ground, thus failing to rotate the brushes or rollers. Similarly, the friction wheel can easily slip, and thus not rotate the rollers, when used on muddy ground or in wet grass. However, when the roller and the conveyor are positively driven by means of individual motors, variations in the distance between the frame and the ground, or in surface conditions, will not interrupt their operation.

Furthermore, the use of separate motors for each of the pickup rollers 26, 28 and the conveyor 30 enables the speed of each of these mechanisms to be controlled independently of the other. For example, in some situations it may be desirable to have the rollers 26, 28 perform a digging operation. In such a case, the rollers can be lowered relative to the conveyor belt, for example by means of the positioning devices 70, and their rotational speed increased to twice that of the conveyor 30 so that they agitate the ground and loosen debris that may be partially buried.

In addition, the variability of the speed of the rollers 26, 28 with respect to the conveyor 30 provides a degree of control over the effective stiffness of the fingers. As rotational speed is increased, the effective stiffness of the fingers also increases. Thus, in situations where small, low density debris is typically encountered, it is generally desirable to rotate the rollers 26, 28 at a slower speed so that the fingers bend to follow the ground contour and "flick" the debris up off the ground towards the conveyor 30, where it is retrieved.

Figure 5:
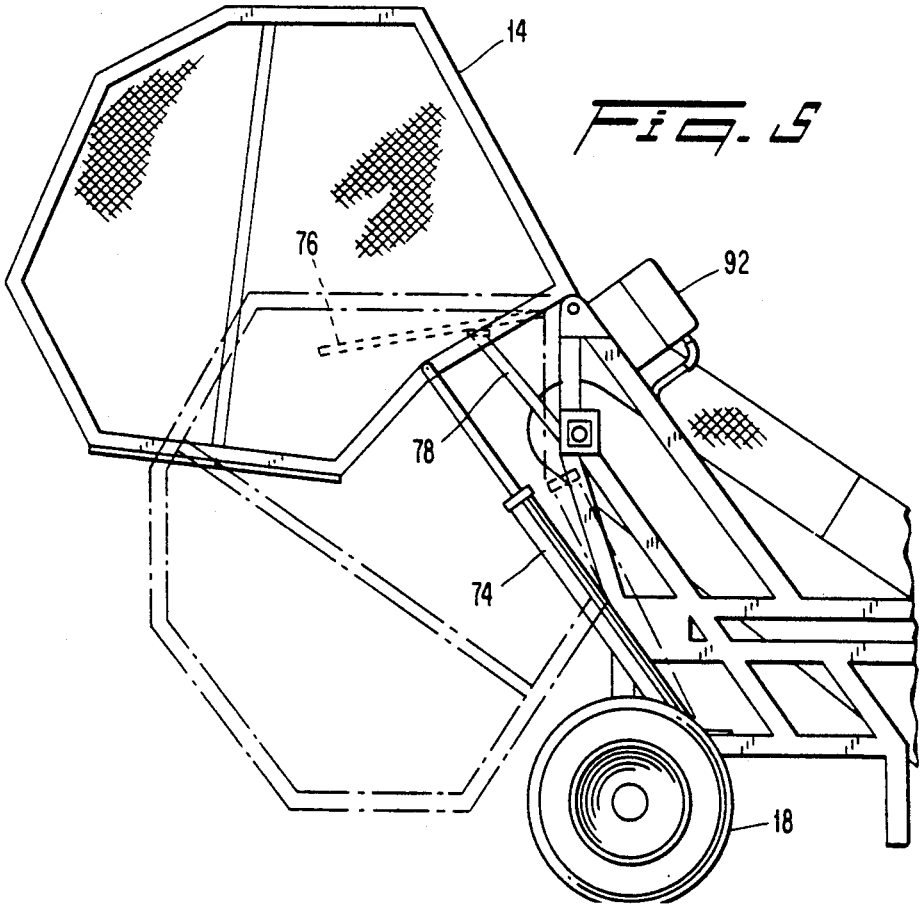
FIG. 5 is a side view of the machine showing the hopper in the raised, dispensing position in solid lines and in the lowered storage position in phantom lines.

With respect to FIG. 5, the hopper 14 is pivotally mounted on the rear of the frame 10. An hydraulic cylinder 74 mounted between the frame 10 and the hopper 14 selectively moves the hopper 14 between a receiving, or storing position, illustrated in FIG. 2 and in broken lines in FIG. 5, and a dispensing or dumping position illustrated in solid lines in FIG. 5 To provide the conveyor 30 with access to the interior of the hopper while it is in the receiving position, but to prevent accidental spillage of contents when it is raised to the dispensing position, the hopper is provided with a gate 76. An abutment 78 that projects from the frame 10 engages the gate 76 to hold it open when the hopper is in the receiving/storing position so that the conveyor 30 can dump litter into the hopper. As the hopper is raised to the dispensing position illustrated in FIG. 5, the gate 76 covers the opening to the hopper so that its contents do not spill out.

Figure 6:
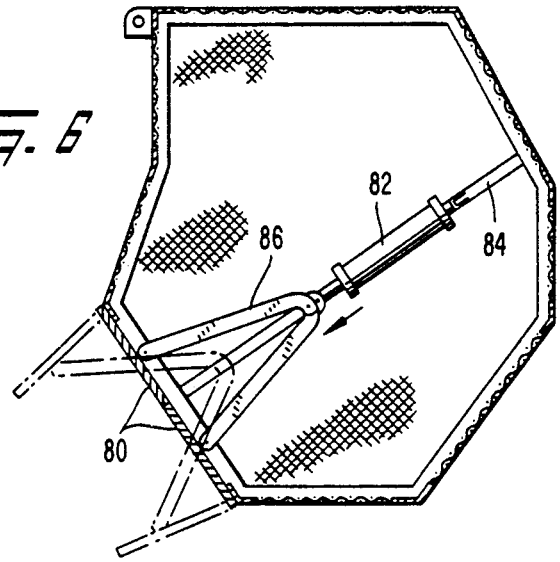
FIG. 6 is a detailed sectional side view of the hopper.

Referring to FIG. 6, to the enable the hopper to be dumped, a pair of pivotable doors 80 are mounted on a lower surface of the hopper. These doors 80 are selectively moved, by means of an hydraulic cylinder 82, between a closed position illustrated in solid lines and an open position illustrated in dashed lines in FIG. 6. One end of the cylinder 82 is connected to a cross member 84 in the hopper, and the other end is connected to a pair of linkage members 86 that transmit the movement of the cylinder 82 to the doors 80. Of course, it will be appreciated that a single door can be used in place of the dual doors 80 illustrated in the Figures.

If desired, the hopper can be provided with a compactor mechanism.

The power for driving the hydraulic motors 58 and each of the hydraulic cylinders 60, 74, and 82 is provided by means of a suitable gasoline or diesel engine 88 mounted on the front of the frame 10. This engine drives an hydraulic pump 90 which supplies hydraulic fluid under pressure to each of the hydraulically operated mechanisms. In addition, a control panel (not shown) can be provided on the front of the frame, for example adjacent the hydraulic pump 90, to selectively actuate each of these cylinders and the pumps. This control panel can include safety lockouts to prevent accidental actuation of the hydraulic mechanisms at the wrong time, for example raising of the hopper while the conveyor is operating. A reservoir 92 for the hydraulic fluid that is supplied by the pump 90 to each of the hydraulically actuated mechanisms can be conveniently located the top of the machine, as illustrated in FIG. 2.

This reservoir 92 can be supported on either the main frame 10 or the subframe 52.

Summarizing the operation of the litter collecting machine, as the machine is towed along the area to be cleaned, hydraulic motors rotate the pickup rollers 26, 28 and the conveyor 30 so that litter located between their respective sets of fingers will be picked up between the rollers 26, 28. During this time, the cylinder 60 operates to maintain the fingers of the rollers 26, 28 in engagement with the ground so as to retrieve all the litter over which the machine passes. The litter will be disengaged from the fingers of the roller by means of the rake 48 and transported upwardly to the hopper 14 by means of the fingers 34 of the conveyor 30. When the litter reaches the upper end of the conveyor it falls into the hopper. Any litter that is engaged between the fingers 34 on the conveyor 30 is removed by the rake 49 on the hopper 14.

When the collecting operation is completed, the machine is towed to a location where the collected litter is to be dumped, and the hopper is raised by the hydraulic cylinder 74, as illustrated in FIG. 5. The gate 76 prevents the litter from falling back out of the hopper. The machine is backed up to place the hopper over a suitable receptacle, or alternatively, a vehicle such as a dump truck can be backed under the hopper 14. The cylinder 82 is then extended to open the doors 80 of the hopper 14, enabling the contents thereof to fall into the receptacle.

As can be seen from the foregoing, the present invention provides a simple yet effective apparatus for collecting ground litter. The positive collecting action provided by the oppositely rotating fingers of the pickup rollers 26, 28 functions to retrieve almost all litter of any substantial size. Furthermore, the integration of the collecting action with the conveyor function reduces the number of handling steps between pickup and storage, thereby increasing the overall efficiency of the machine.

Alternatively, the present invention can be incorporated in a device wherein the hopper can be raised substantially in a vertical direction (or at a slight angle) for dumping, without having to pivot the hopper.

It will be appreciated by those of ordinary skill in the art that the present invention can be embodied in other specific forms without departing from the essential characteristics thereof. For example, with reference to FIG. 7, a second preferred embodiment of the present invention is shown schematically. Instead of using one pair of pickup rollers 26, 28 to pickup litter from the ground and a separate conveyor assembly 30 for conveying the litter to the hopper, the second preferred embodiment uses two parallel conveyor assemblies 102, 104 to both pick the litter up from the ground and convey it to the hopper 114. The first conveyor assembly 102 includes a lower conveyor support roller 106 and an upper conveyor support roller 108 and a conveyor belt 110 having a plurality of fingers 112 projecting radially therefrom. The second conveyor assembly 104 includes a lower conveyor support roller 115 and an upper conveyor support roller 116, a conveyor belt 118 and a plurality of fingers 120 projecting radially therefrom. The fingers may be mounted to the conveyor belts 110, 118 by means of the mounting apparatus disclosed above and illustrated in FIG. 4.

Figure 7:
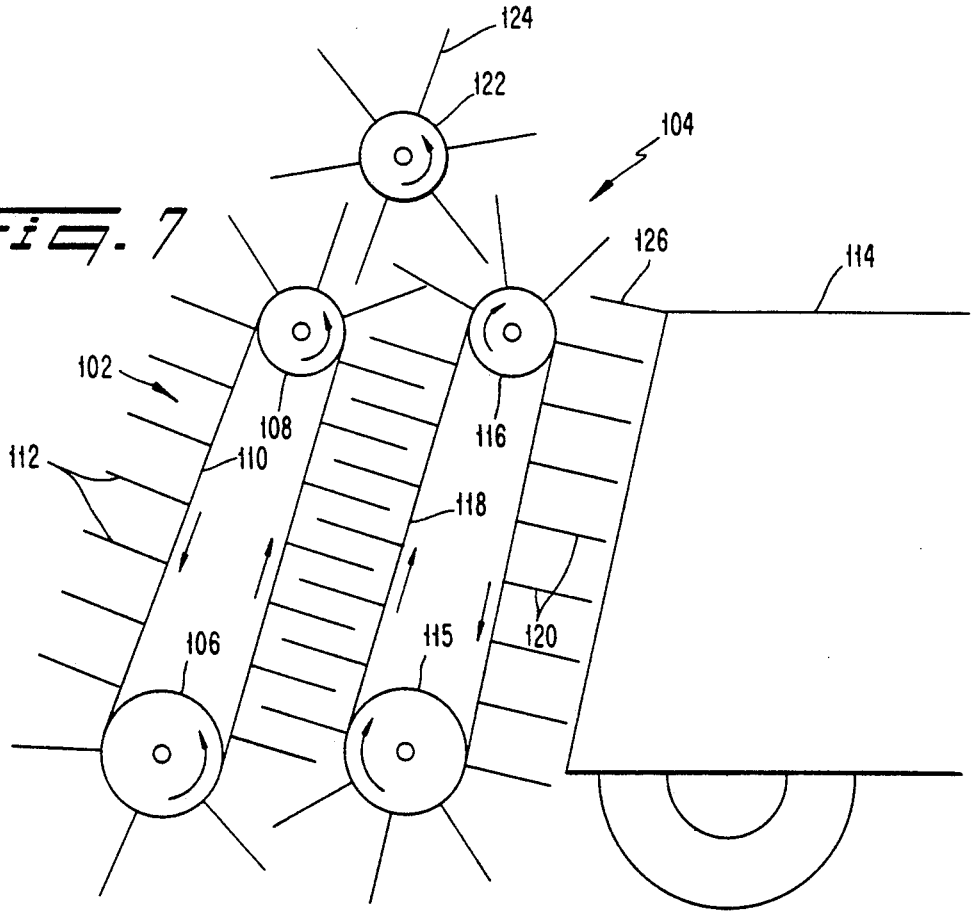
FIG. 7 is a schematic view showing the operation of a second preferred embodiment of the present invention.

As indicated by the arrows in FIG. 7, the conveyor assemblies 102, 104 are designed to rotate in opposite directions, and are located such that the fingers 112 interengage with the fingers 120 so as to pick up litter from the grounds and convey it in an upwardly direction to the top of the hopper 114. Because the two conveyor assemblies 102, 104 are substantially parallel to each other, the litter can be conveyed in a substantially vertical direction, thus enabling the cleaning machine to be made of a shorter length, and with a resulting improved turning radius.

A roller 122 having a plurality of fingers 124 projecting radially therefrom may be provided above the two conveyor assemblies 102, 104, and adapted for rotation in the direction shown in FIG. 7. The roller 122 and its connected fingers 124 are intended to serve as a rake to disengage litter from the fingers 112, 120 of the conveyor assemblies 102, 104.

A rake 126 may also be provided at the top of the hopper 114 to facilitate disengaging litter from the fingers 12 of the second conveyor assembly 104.

Figure 8:
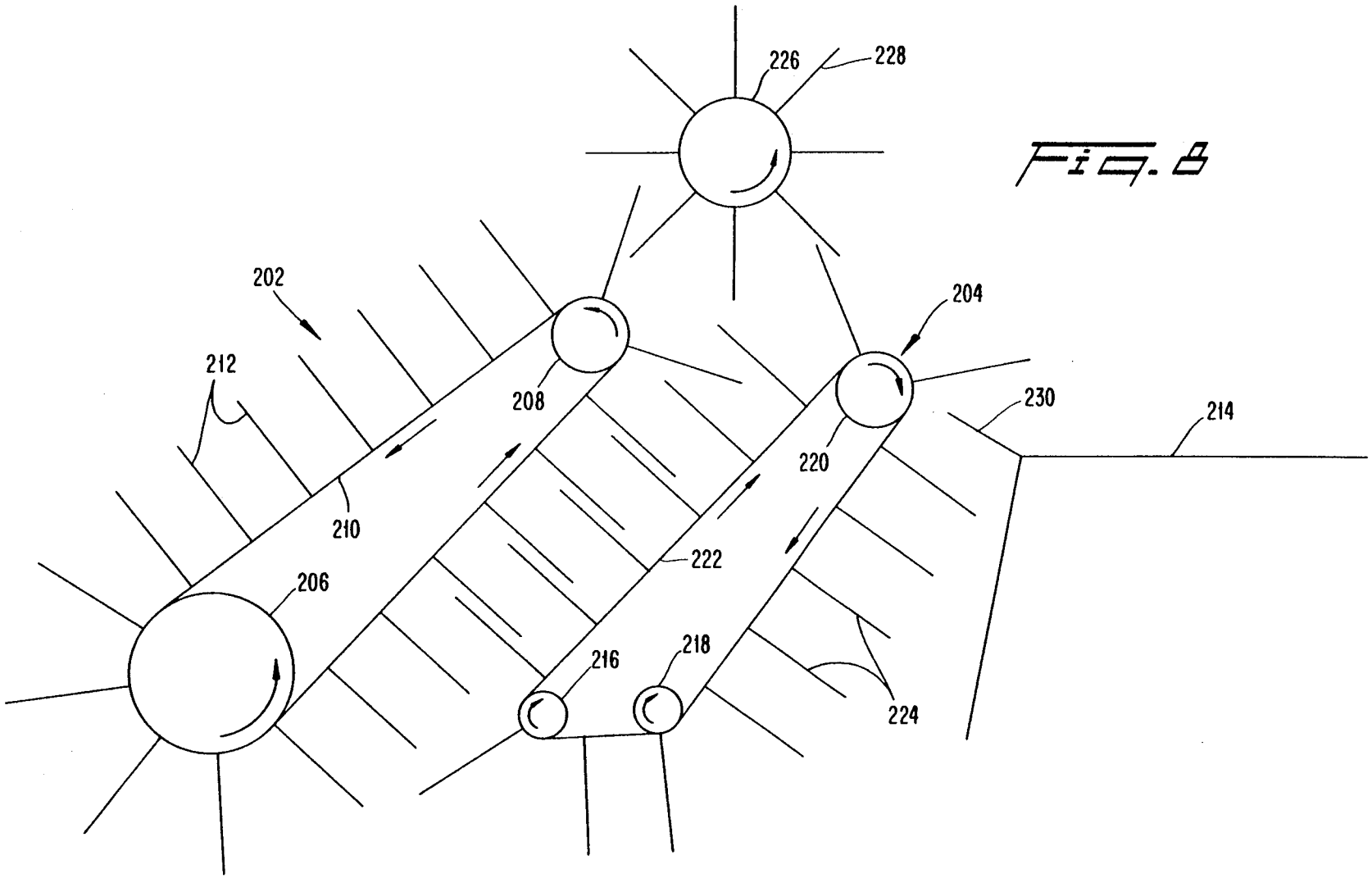
FIG. 8 is a schematic view showing the operation of a third preferred embodiment of the present invention.

With reference to FIG. 8, a third preferred embodiment of the present invention comprises a first conveyor assembly 20 and a second conveyor assembly 204. The first conveyor assembly 202 includes a lower conveyor support roller 206 and an upper conveyor support roller 208, with a conveyor belt 210 provided about the upper and lower support rollers 206, 208. A plurality of radially extending fingers 212 are provided on the belt 210.

The second conveyor assembly 204 includes two lower support rollers 216, 218 and an upper conveyor support roller 220. A conveyor belt 222 is provided about the three support rollers 216, 218, 220. A plurality of radially extending fingers 224 are fixed to the conveyor belt 222.

The fingers 212, 224 may be fixed to their respective conveyor belts 210, 222 by the means described above and illustrated in FIG. 4.

The two conveyor assemblies 202, 204 are arranged substantially vertical and substantially parallel to one another, and are rotated in opposite directions, as illustrated in FIG. 8. The fingers 212 of the first conveyor assembly 202 intermesh with the fingers 224 of the second conveyor assembly 204 so that litter picked up from the ground is carried upwardly between the two conveyor assemblies for depositing in the hopper 214. The two conveyor assemblies 202, 204 can be arranged in a substantially vertical manner in order to shorten the overall length of the cleaning machine, which thus improves the turning radius thereof.

A roller 226 with fingers 228 projecting radially therefrom may also be provided above the conveyor assemblies 202, 204 in order to function as a rake to disengage litter stuck between the fingers 212 of the first conveyor assembly 202, and to convey such litter toward the hopper 214.

In addition, a rake 230 may also be provided on the edge of the hopper 214 in order to disengage litter from the fingers 224 of the second conveyor assembly 204.

Because the second conveyor assembly 204 is provided with two lower support rollers 216, 218, the conveyor belt 222 is thus provided with greater surface contact to the ground. Such greater surface contact facilitates the ability of the cleaning machine to dislodge litter that might be stuck in the ground. Because the fingers 224 are easily replaceable, the additional wear on the fingers caused by the increased surface contact with the ground is not a significant problem.

Figure 9:
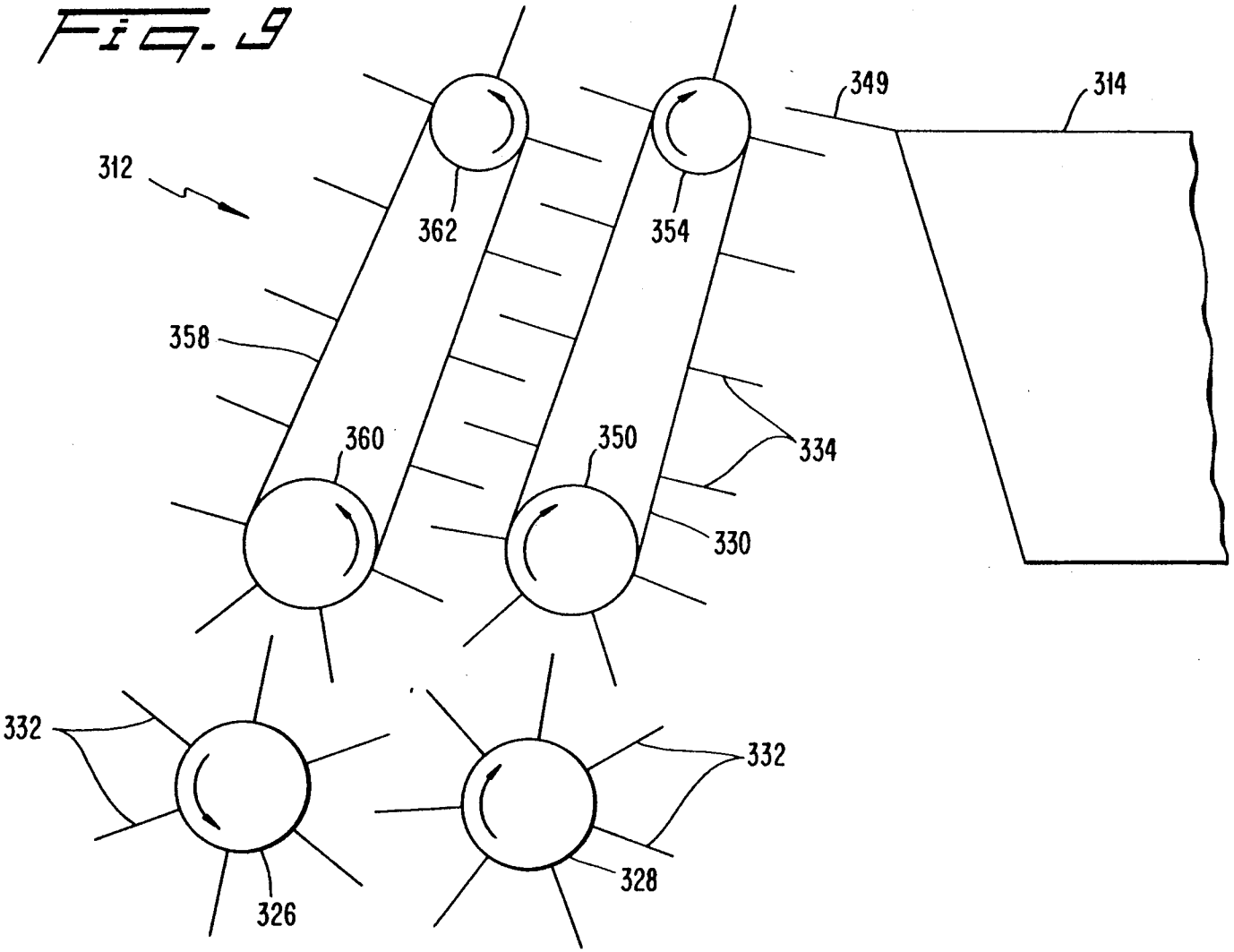
FIG. 9 is a schematic view illustrating the operation of a fourth preferred embodiment of the present invention.

With reference to FIG. 9, a fourth preferred embodiment of the present invention is disclosed. The fourth embodiment is similar to the first embodiment except where indicated accordingly in the following description. With reference to FIG. 9 the collector assembly 312 comprises two pickup rollers 326, 328 and two inclined conveyors 330, 358. Each of the pickup rollers 326, 328 and the conveyors 330, 358 extends substantially over the width of the collecting machine. The pickup rollers 326, 328 are parallel to each other, and are contained in a horizontal plane, raised above and parallel to the surface that is to be cleaned.

As shown schematically in FIG. 9, each of the rollers 326, 328 is provided with a plurality of flexible, radially extending fingers 332 over the peripheral surface thereof. The fingers 332 are preferably of a solid cylindrical configuration, and extend about 10 to 11 inches from the peripheral surface of the rollers 326, 328.

The rollers 326, 328 may comprise a metal tube that is concentrically supported on a shaft. The fingers 332 are mounted on the tube in spaced rows extending into both the axial and circumferential directions.

The first inclined conveyor 330 has a lower end adjacent the pickup roller 328, and an upper end in an operative relationship with the hopper 314. The first conveyor belt 330 can be constructed of rubber, flexible metal, such as steel mesh, or any other suitable material. The belt is supported by a lower guide roller 350 and an upper guide roller 354.

The fingers 334 on the first conveyor 330 are made from a material that enables the fingers to be heavier and stiffer then the fingers 332 used on the pickup rollers 326, 328.

The direction of rotation of the pickup rollers 326, 328 is indicated by arrows marked on the respective rollers in FIG. 9. As can be best seen in FIG. 9, the pickup rollers 326, 328 are driven in opposite directions such that the fingers 332 of pickup roller 326 overlap and intermesh with the fingers 332 of pickup roller 328. For example, if the fingers each have a length in the range of 10 to 11 inches, the overlap might be about 8 inches along a line intersecting the axes of rotation of the pickup rollers 326, 328.

Instead of the clean out rake 48 used in the embodiment of FIG. 3, the fourth preferred embodiment includes a second inclined conveyor 358 having a lower end adjacent the pickup roller 328, and an upper end in an operative relationship with the hopper 314. The second conveyor belt 358 can be constructed of rubber, flexible metal, such as steel mesh, or any other suitable material. The belt is supported by a lower guide roller 360 and an upper guide roller 362 The second inclined conveyor 358 may be provided on the frame in a manner so that it is suspended above the pickup roller 326 such that the teeth of the second inclined conveyor 358 interengage with the fingers 332 of the pickup roller 326. A purpose of the second inclined conveyor 358 is to cooperate with the first inclined conveyor 330 so as to dislodge any litter that may have been stuck between adjacent fingers 332 of the pickup rollers 326, 328 and to convey such litter into the hopper 314.

A rake 349 may be provided on the hopper 314 for dislodging litter from the fingers 334 of the conveyor 330 as the fingers 334 pass over the top of the conveyor.

The embodiment of FIG. 9 has an advantage over the FIG. 3 embodiment in that it may be constructed with a shorter wheelbase. The embodiment of FIG. 9 has an advantage over the FIG. 8 embodiment in that it has fewer fingers that contact the ground and that are subject to wear. In the FIG. 9 embodiment, only the fingers on rollers 326 and 328 contact the ground, whereas in the FIG. 8 embodiment, all of the fingers on belts 210 and 222 contact the ground and are subject to wear.

Although not specifically illustrated in the attached figures, it should be clear to those skilled in the art that the collector assemblies schematically illustrated in FIGS. 7–9, and discussed above, may be provided on a frame 10 and subframe 52 such as those described above and illustrated in FIGS. 1, 2, 5 and 6. Furthermore, the hydraulic system disclosed above with respect to the first preferred embodiment may of course also be used with the second, third, and fourth preferred embodiments. The one difference that may be found between a frame used on the first preferred embodiment and a frame usable with the second, third, or fourth preferred embodiments is that a frame for the second, third, or fourth preferred embodiments may be made shorter than the frame used for the first preferred embodiment, because of the fact that the conveyor assemblies may be mounted in a substantially vertical direction.

Figure 10:
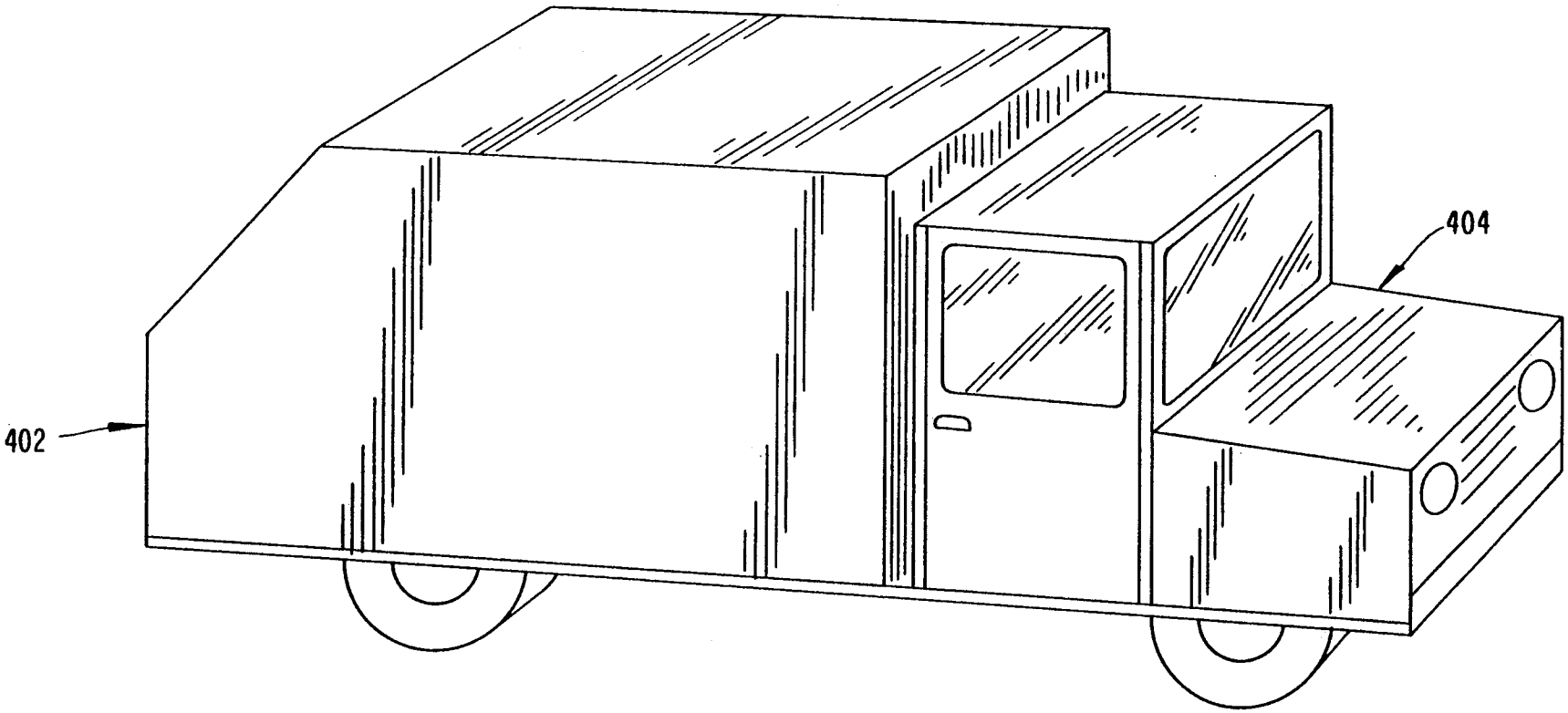
FIG. 10 is a schematic view illustrating a fifth preferred embodiment of the present invention.

With reference to FIG. 10, as an alternative to being towed, each of the embodiments of the present invention can be made as a self-contained, self-propelled unit 402, provided with a suitable cab 404 for a driver and appropriate conventional structures for driving and steering the machine.

Furthermore, while the illustrated embodiments of the invention employ a belt for the conveyor, other suitable structures can be used as well. Instead of a solid belt, a parallel arrangement of chains that are spaced across the peripheral surface of the guide rollers and can be used to provide a mounting for the fingers. To prevent smaller pieces of litter from falling through the spaces between the chains and back to the ground, a suitable plate made of either solid or expanded metal can be provided underneath the conveyor. In another alternative embodiment, the conveyor could be comprised of two thin belts or strips disposed at opposite ends of the guide rollers and with a series of spaced transverse bars straddling the two strips. The fingers of the conveyor can be mounted on these bars. Again, a plate can be provided beneath. the upper layer of the conveyor to prevent litter from falling down.

Furthermore, other arrangements for mounting the collector subassembly on the frame or for mounting the motors for driving the roller and conveyor can be employed within the context of the present invention.

The presently disclosed embodiments are therefore considered in all respects to be illustrative and not restrictive. The scope of the invention is indicated by the appended claims rather than the foregoing description, and all changes that come within the meaning and range of equivalents thereof are intended to be embrace therein.

What is claimed is:

1. An apparatus for collecting litter from the ground, comprising:

a frame adapted for movement along the ground;

a hopper mounted at one end of said frame; and a collector assembly supported on said frame, said collector assembly including:

first and second conveyor assemblies arranged substantially parallel to each other;

each of said conveyor assemblies including a belt, means for supporting a lower region of the belt and means for supporting an upper region of the belt;

fingers disposed on the outer periphery of each said belts, said belts and fingers arranged such that the fingers of said first conveyor assembly intermesh with the fingers of said second conveyor assembly;

means for driving the belts in opposite directions; and a roller mounted to said frame above said conveyor assemblies, said roller having fingers disposed on the outer periphery thereof and arranged such that the fingers thereof intermesh with the fingers of one of said conveyor assemblies.

2. The apparatus of claim 1, wherein said conveyor assemblies are arranged substantially vertically.

3. The apparatus of claim 1, wherein the lower belt support means and the upper belt support means comprise rollers.

4. The apparatus of claim 1, further comprising a plurality of tubes extending radially from each of said belts, wherein each of said fingers is mounted within a respective tube, and removable means for securing the fingers in their respective tubes.

5. The apparatus of claim 1, further comprising an assembly for detachably mounting a finger to the rollers and the conveyor assemblies, said mounting assembly comprising:

a tube secured by an attached end thereof to one of the rollers and the conveyor assemblies and being open at a free end thereof;

said tube being internally cylindrical over a majority of its length and adapted at the free end thereof to receive a finger; and means for securing said finger within said cylindrical tube.

6. An apparatus for collecting litter from the ground, comprising:

a frame adapted for movement along the ground in a direction of movement;

a hopper mounted at one end of said frame; and a collector assembly supported on said frame, said collector assembly including:

a pair of rollers having a plurality of flexible fingers disposed radially on the periphery thereof, said rollers being substantially parallel to each other and disposed in a plane that is substantially parallel to the ground;

said rollers arranged so that the fingers on one of said pair of rollers intermesh with the fingers of the other of said pair of rollers so as to be able to lift litter between them;

means for conveying litter lifted by said pair of rollers to the hopper, said conveying means including:

first and second conveyor assemblies arranged substantially parallel to each other;

each of said conveyor assemblies including a belt, means for supporting a lower region of the belt and means for supporting an upper region of the belt;

fingers disposed on the outer periphery of each of said belts, said belts and fingers arranged such that the fingers of said first conveyor assembly intermesh with the fingers of said second conveyor assembly; and means for driving the belts in opposite directions;

wherein said conveying means is mounted above said pair of rollers so that the fingers of each of said pair of rollers intermesh with respective fingers on said conveyor assemblies; and means for rotating the pair of rollers and said belts about axes that are substantially transverse to the direction of movement of said frame.

7. The apparatus of claim 6, wherein said conveyor assemblies are arranged substantially vertically.

8. The apparatus of claim 6, wherein the lower region belt support means and the upper region belt support means comprise rollers.

9. The apparatus of claim 6, further comprising a plurality of tubes extending radially from each of said belts, wherein each of said fingers is mounted within a respective tube, and removable means for securing the fingers in their respective tubes.

10. The apparatus of claim 6, further comprising an assembly for detachably mounting a finger to the rollers and the conveyor assemblies, said mounting assembly comprising:

a tube secured by an attached end thereof to one of the rollers and the conveyor assemblies and being open at a free end thereof;

said tube being internally cylindrical over a majority of its length and adapted at the free end thereof to receive a finger; and means for securing said finger within said cylindrical tube.

* * * * *